US011892276B2

(12) United States Patent
Jones et al.

(10) Patent No.: US 11,892,276 B2
(45) Date of Patent: Feb. 6, 2024

(54) REAR ILLUMINATION PROJECTILE

(71) Applicant: Savit Corporation, Rockaway, NJ (US)

(72) Inventors: Kenneth R. Jones, Wayne, NJ (US); Nicholas C. Korinis, II, Franklin Lakes, NJ (US); Stojan Kotefski, Wayne, NJ (US)

(73) Assignee: Savit Corporation, Rockaway, NJ (US)

( * ) Notice: Subject to any disclaimer, the term of this patent is extended or adjusted under 35 U.S.C. 154(b) by 22 days.

(21) Appl. No.: 17/643,352

(22) Filed: Dec. 8, 2021

(65) Prior Publication Data

US 2023/0175822 A1 Jun. 8, 2023

(51) Int. Cl.

| | |
|---|---|
| ***F42B 12/40*** | (2006.01) |
| ***F42B 12/42*** | (2006.01) |
| ***F42B 12/36*** | (2006.01) |
| ***F42B 12/38*** | (2006.01) |

(52) U.S. Cl.

CPC ..... *F42B 12/40* (2013.01); *F42B 12/36* (2013.01); *F42B 12/382* (2013.01); *F42B 12/42* (2013.01)

(58) Field of Classification Search

CPC ..... F42B 8/02; F42B 8/12; F42B 8/14; F42B 12/38; F42B 12/382; F42B 12/40; F42B 12/42; F42B 12/36

USPC ..... 102/444, 513

See application file for complete search history.

(56) References Cited

U.S. PATENT DOCUMENTS

| | | | | |
|---|---|---|---|---|
| 8,297,187 | B2 * | 10/2012 | Sullivan | F42B 12/40 102/370 |
| 8,881,655 | B2 * | 11/2014 | Aw | F42B 12/40 102/512 |
| 11,287,236 | B1 * | 3/2022 | Dindl | F42B 12/40 |
| 2005/0263029 | A1 * | 12/2005 | Kumar | F42B 8/12 102/498 |
| 2015/0083012 | A1 * | 3/2015 | Mutascio | F42B 12/38 102/513 |

FOREIGN PATENT DOCUMENTS

| | | | | |
|---|---|---|---|---|
| CN | 112964137 B | * | 7/2022 | F42B 8/00 |
| KR | 101707958 B1 | * | 2/2017 | F42B 12/42 |
| WO | 2022169613 A2 | | 8/2022 | |

OTHER PUBLICATIONS

Machine translation of CN-112964137-B (Year: 2022).*
Machine translation of KR-101707958-B1 (Year: 2017).*

* cited by examiner

*Primary Examiner* — James S Bergin
(74) *Attorney, Agent, or Firm* — Patterson + Sheridan, LLP

(57) ABSTRACT

Embodiments of the present disclosure relate to the field of ammunition rounds for training or tactical purposes. In one or more embodiments, the projectile is equipped to transmit an improved visual signature upon impact, including one or both of flash and smoke signatures. In one example, a projectile includes a projectile body, an ogive coupled to the projectile body, and a boat tail having a degree of transparency coupled to the projectile body. The boat tail having a degree of transparency and the projectile body define a cavity within the boat tail having a degree of transparency and the projectile body. A flash producing material is disposed within the cavity.

18 Claims, 4 Drawing Sheets

REAR ILLUMINATION PROJECTILE

BACKGROUND

Field

Embodiments of the present disclosure relate to the field of ammunition rounds for training or tactical purposes. In one or more embodiments, the projectile is equipped to transmit an improved visual signature upon impact.

Description of the Related Art

Training projectiles are utilized to simulate safe but accurate ammunition rounds for training purposes. To best provide an accurate training experience, the training projectiles should accurately simulate the effects seen in combat. In addition, the training projectiles should be equipped to emit signals that provide point of impact visibility at all hours of day. Training projectiles further need to be safe and reliable for regular training use. As such, there are many challenges and design constraints with training ammunition.

Conventional attempts to provide visual and/or audible signals include powders, energetic flash mixtures, flash bulbs, and chemical glow stick interiors. These solutions can be unreliable, resulting in potential early detonation or delayed detonation and duds if the signals do not go off upon impact. Further, thermal, smoke, and flash signals which deploy from the top or rear of the ammunition (which impacts the ground first), do not always provide sufficient visibility upon impact.

Accordingly, there is a need in the art for improved training ammunition rounds.

SUMMARY

In one example, a projectile includes a projectile body, an ogive coupled to the projectile body, and a boat tail having a degree of transparency coupled to the projectile body. The boat tail and the projectile body define a cavity within the boat tail and the projectile body. A flash producing material is disposed within the cavity.

In another example, a projectile includes a projectile body, an ogive coupled to the projectile body, a boat tail having a degree of transparency coupled to the projectile body, an oxidizer disposed in a constrained volume within the projectile body, and a plurality of powder channels disposed between the oxidizer and an external sidewall of the projectile body.

In another example, a projectile includes a projectile body, an ogive coupled to the projectile body, a boat tail having a degree of transparency coupled to the projectile body, and a first cavity defined by the projectile body and the ogive. The first cavity includes a support post disposed within the cavity, and a firing pin disposed within a pocket of the support post. A second cavity is defined by the boat tail and the projectile body. The second cavity includes a flash producing material disposed in the second cavity. A detonator is disposed between the first cavity and the second cavity. An oxidizer is disposed between the firing pin and detonator, and a plurality of powder channels extend between the oxidizer and an external surface of the projectile body.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure relate to the field of ammunition rounds for training or tactical purposes. In one or more embodiments, the projectile is equipped to transmit an improved visual signature upon impact. The improved visual signature may be achieved through one or both of rear flash and side smoke signatures. The visual signature comprises a rapid flash, rather than one that persists or lingers, in order to closely simulate a real grenade. For example, the flash ceases to emit light within three seconds. The disclosed cartridges (and projectiles thereof) provide identifiable points of impact at varying times of day and levels of visibility, while providing a safe training option designed to prevent field fires, prevent ignition of adjacent combustibles and prevent hazardous duds.

Figure 1:
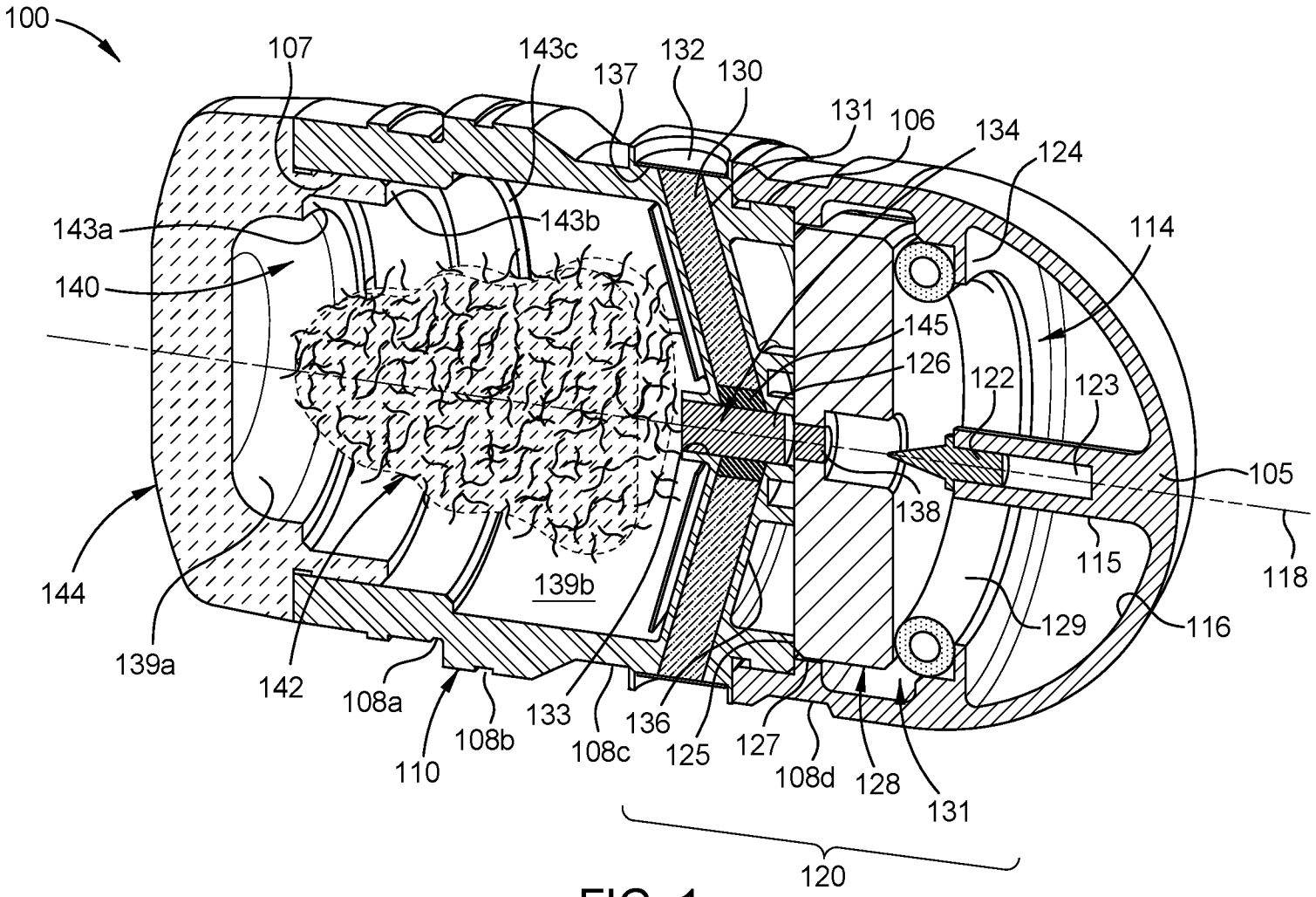
FIG. 1 is a cross sectional view of a projectile of a cartridge, according to one implementation.

FIG. 1 is a cross sectional view of a projectile 100 of a cartridge, according to one implementation. The projectile 100 includes a projectile body 110 coupled to a ogive 105 at a fore end of the projectile body 110 and coupled to a boat tail 144 at an aft end opposite the ogive 105. The projectile body 110 and the ogive 105 are formed from brass, steel, copper or other suitable material, while the boat tail having a degree of transparency 144 is formed from any suitable transparent, translucent or semi-transparent material, such as polycarbonate, acrylic, quartz, glass or other clear and/or transparent material, for example, alkali-aluminosilicate glass. However, other materials having a degree of transparency are also contemplated.

The boat tail having a degree of transparency may be completely transparent or may be only partly transparent or translucent. As used herein, "degree of transparency" encompasses materials with sufficient transparency and/or translucency that a light signature (e.g., visible and/or infrared light) is visible therethrough. Therefore, it is to be understood that the phrase "degree of transparency" is intended to encompass both transparent and translucent materials that allow some degree of a visible signature to be seen therethrough. In one example, the boat tail having a degree of transparency may let 100% of light (at visible and/or infrared wavelengths) pass through (e.g., completely transparent). In another example, the boat tail having a degree of transparency may let 90% of light pass through. In another example, the boat tail having a degree of transparency may let 80% of light pass through. In another example, the boat tail having a degree of transparency may let 70% of light pass through. In another example, the boat tail having a degree of transparency may let 60% of light pass through. In another example, the boat tail having a degree of transparency may let 50% of light pass through. In another example, the boat tail having a degree of transparency may let 40% of light pass through. In another example, the boat tail having a degree of transparency may let 30% of light pass through. In another example, the boat tail having a degree of transparency may let 20% of light pass through. In another example, the boat tail having a degree of transparency may let 10% of light pass through. The boat tail having a degree of transparency permits the passage of light such that a visual signal is visible to the operator.

The ogive 105 is assembled to the projectile body 110 at a mating interface 106, for example by threading, press fit, swaging, crimping, bonding or other suitable technique. Similarly, the boat tail 144 is assembled to the projectile body 110 at the mating interface 107, for example by threading, press fit, swaging, crimping, bonding or other suitable technique. The projectile body 110 includes a plurality of ringed grooves 108*a*-108*c*, such as cannelures (three are shown) or other surface features (e.g., grooves) formed on an external surface of the projectile body 110 to reduce weight and facilitate one or more of loading, firing, or ballistic accuracy of the projectile 100. It is contemplated, however, that the projectile body 110 may include more or less ringed grooves, including zero ringed grooves. Similarly, the ogive 105 of the projectile 100 includes a ringed groove 108*d* formed in the outer surface of the ogive 105 at a base of the ogive 105 adjacent the projectile body 110. In one example, the ringed grooves is concentric or partially concentric with the mating interface 106. It is noted that the ringed groove 108*d* may be omitted, or that the ogive 105 may include additional ringed grooves.

The ogive 105 and the projectile body 110 couple together to define a first cavity 114. The ogive 105 includes a support post 115 extending from an apex of an interior domed surface 116. The support post 115 is axially-aligned with a longitudinal axis 118 of the projectile 100. The support post 115 includes a pocket 123 formed in a distal end of the support post 115, in which a firing pin 122 is disposed. The firing pin 122 includes a pointed end directed towards a stab detonator 138 (for example, an M55 detonator) interfaced with the escapement 128 to facilitate planned detonation of the detonator 138 during operation. The firing pin 122 may be formed from brass or a steel alloy, such as stainless steel or carbon steel. While the firing pin 122 is illustrated as a separate component from the support post 115, it is contemplated that the firing pin 122 and the support post 115 may be formed monolithically.

The ogive 105 further includes a shoulder 124. The shoulder 124 is a feature for retaining a biasing member 129, such as an elastomeric ring (e.g., O-ring, gasket, or other compressible seal), a spring or the like, in a fixed initial (i.e., pre-impact) position. The shoulder 124 is a ring-shaped structure extending radially inward from the interior domed surface 116, orthogonal to the longitudinal axis 118. However, other physical features which maintain the biasing member 129 in a fixed position are contemplated, including tabs, channels, adhesives, or other retention mechanisms. The biasing member 129 is maintained in position against the escapement 128, which houses the detonator 138 centrally therein adjacent the firing pin 122. The biasing member 129 may be formed of a rubber or other polymeric material and provides sufficient flexural rigidity to prevent inadvertent contact of the firing pin 122 with the escapement 128, which still being compressible and/or deformable. It is contemplated that other flexible members may be used in place of the biasing member 129 to prevent inadvertent contact of the firing pin 122 with the escapement 128. For example, the biasing member 129 may be replaced with one or more springs or flexible members as the biasing member.

The escapement 128 is a clockwork mechanism which prevents inadvertent detonation of the detonator 124. For sake of explanation, the escapement 128 is illustrated with the detonator 124 unobstructed by the clockwork mechanism of the escapement 128. The escapement 128 is axially-movable within the ogive 105 along the axis 118. The escapement 128 is biased rearward by the biasing member 129 against an upper surface 125 of the projectile body 110. A lower, inner lip 127 of the ogive 105 engages a radially outward edge of the escapement 128 to maintain alignment of the escapement 128 relative to the firing pin 122. A recess 131 is formed adjacent the lower, inner lip 127 radially outward of the escapement 128. The size of the recess 131 relative to the contact area of the lower inner lip 127 and the escapement 128 may be adjusted to tailor frictional resistance between the lower inner lip 127 and the escapement 128. The amount of frictional resistance, combined with the flexural resistance of the biasing member 129, facilitates desired axial movement of the escapement 128, thus providing appropriately-timed detonation of the projectile 100, while simultaneously mitigating premature detonation.

The firing pin 122 and the escapement 128 are axially aligned with and operably coupled with (e.g., configured to ignite) the oxidizer/booster 126. The oxidizer/booster 126 is potassium perchlorate (or another suitable oxidizer) disposed in a volume 134 of the projectile body 110 defined by interior surface 133. As shown in FIG. 1, the interior surface 133 defines a cylindrical volume, but other geometric shapes are contemplated. The projectile body 110 also includes a plurality of powder channels 136 housing signal powder 130, such as titanium dioxide or talc which is expelled via an optional piston 145. It is contemplated that the piston 145 may be omitted in some embodiments. Each powder channel 136 (two are shown) of the plurality of powder channels 136 extends from the oxidizer/booster to an external surface 137 of the projectile body 110. Environmental seals 132 (e.g., paper, plastic, cloth, or other covering) are positioned over the distal end of each powder channel 136. In one embodiment, the environmental seals 132 are in contact with the external surface 137 of the projectile body 110 to protect the signal powder 130 from environmental exposure. In another embodiment, the environmental seal 132 may be located within the powder channel 136. Each powder channel 136 is operably coupled to the oxidizer/booster 126 via the piston 145. Each powder channel 136 is positioned at an angle relative to the axis 118 to facilitate expulsion of the signal powder 130 as the oxidizer/booster 126 combusts. In one example, the angle of each powder channel 136 relative to the axis 118 is 90 degrees or less, such as about 90 degrees to about 65 degrees, or about 85 degrees to about 65 degrees, or about 70 degrees to about 80 degrees. While two powder channels 136 are illustrated, it is to be noted that more or less than two powder channels 136 may be utilized. For example, one powder channel, three powder channels, or four powder channels 136 may be utilized. In such an example with two or more powder channels, the powder channels 136 may be spaced at equal angular intervals (e.g., 90 degrees from one another when four powder channels are utilized) to facilitate ballistic flight.

The boat tail 144 and the projectile body 110 couple together to define a second cavity 140 (e.g., flash chamber) which is separated from the first cavity 140 by the escapement 128. The second cavity 140 houses a flash producing material 142. The flash producing material 142, for example, may be a flash wool or flash powder, such as magnesium, titanium, aluminum, or zirconium wool (or powder). The flash producing material 142 is disposed in the rear flash chamber 140 adjacent to the oxidizer/booster 126. The flash wool is positioned to be ignited by the oxidizer/booster 126 upon combustion of the oxidizer/booster 126.

Interior surfaces of the rear flash chamber 140 (defined by an interior surface 139*a* of the boat tail 144 and interior surface 139*b* of the projectile body 110) include one or more shoulders 143*a*-143*c* (three are shown) formed therein. The shoulders 143*a*-143*c* are formed to facilitate proper weight balance of the projectile 100 and/or proper strength of the projectile 100. It is contemplated that more or less shoulders may be included, including zero. The boat tail 144, as illustrated, forms a cup shape, however, other shapes are also contemplated. In the cup shape configuration as illustrated, the boat tail 144 forms part of the sidewall of the projectile 100. This enables the flash signatures to be visible from both the rear of the boat tail 144, and the sides of the boat tail 144, thus improving flash visibility from multiple observer angles.

While embodiments described above utilized an escapement 124, other detonation devices are also contemplated. For example, it is contemplated that a spring-biased plate may be utilized to protect the detonator 138 from premature detonation. In such an example, the spring-biased plate would cover the detonator 138 until sufficient rotational force overcame the force of the spring, moving the plate and exposing the detonator 138 for contact with the firing pin 122.

During operation, the projectile 100 is fired from a firearm. Rotation of the projectile 100 due to rifling of the firearm induces a centripetal force to the escapement 128, actuating the clockwork gearing of the escapement 128 and bringing the detonator 138 in line with (or exposing the detonator 138 to) the firing pin 122. The escapement 128 may be timed such that the detonator 128 is not aligned with the firing pin 122 until a predetermined time has elapsed, thus preventing ignition of the projectile 100 within that predetermined time period. In such an example, if the projectile 100 inadvertently contacts an object prior to expiration of the predetermined time, detonation is avoided. Such a feature is particularly advantageous for preventing detonation in close proximity to an operator, or in any other scenario in which the round is not gun launched.

When the projectile 100 contacts an object, momentum displaces the escapement 128 forward relative to the ogive 105 and compresses the biasing member 129 until the firing pin 122 engages the detonator 138. Ignition of the detonator 128 correspondingly ignites the booster/oxidizer 126.

The ignition of the booster/oxidizer 126 in turn ignites and/or discharges the signal powder 130, pushing the signal powder 130 through the powder channels 136 toward the environmental seals 132 on the external surface 137 of the projectile body 110. In one embodiment, the signal powder 130 is pushed out through the powder channels 136 via the piston 145. The signal powder 130 ruptures the environmental seals 132, and emits a visual (e.g., smoke) signal from the external surface 137 of the projectile body 110, facilitating daytime visibility of point of impact of the projectile 100. Ejection of the signal powder 130 from the lateral sides of the projectile body 110 leaves the boat tail 144 visually unobscured, thereby increasing the nighttime visual signature (through the boat tail 144) of the projectile 100. Ejection of the signal powder 130 from the lateral sides of the projectile body produces a larger smoke plume compared to ejection from the back of the projectile body 110, by increasing the lateral size (e.g., width) of the plume. The plume is a powder configured to reflect light. In some embodiments, the plume may contain metal fragments to intensify the light reflection. The ejection of the signal powder 130 from the lateral sides of the projectile body further allow for control of the smoke plume, by providing control of the volume and orientation of the signal powder 130. The light emission from the boat tail 144 reflects off the generated smoke plume, creating a visible signal in daylight and/or a larger/more visible signal in the dark.

The ignition of the booster/oxidizer 126 also ignites the flash producing material 142. The ignition of the flash producing material 142 produces a light signal (e.g., infrared (thermal) and/or visible light signals), which is visible through the transparent boat tail 144. In some embodiments, the interior surfaces of the rear flash chamber 140, such as interior surfaces 139*a* and 139*b*, may be polished, nickel or chrome plated, or have another reflective material deposited thereon in order to increase the brightness (e.g., visible signature) of the light signal by redirecting or controlling the light emission and intensity. The reflector can refocus or concentrate the emitted light in order to optimize the light dispersion and orientation, improving visibility. The reflector focuses the light through the rear of the projectile rather than scattering the light signal within the projectile or through the sides of the projectile, which increases the perceived intensity to spectators, particularly those behind the flight path of the projectile. In some embodiments, the rear flash chamber 130 may include a reflector component, such as a parabolic dish disposed therein or disposed on surfaces within the rear flash chamber 130. Because the boat tail 144 allows light to pass through, nighttime visibility is improved relative to conventional training projectiles. For example, training projectiles have a tendency upon impact with an object, such as the ground, to become at least partially buried therein. In doing so, only the rear portion of the boat tail 144 of the projectile remains uncovered with the impact hole. Thus, forming the boat tail 144 from light transmissive material greatly improves visibility of the flash signature of the projectile 100, even when partially buried. In addition, visibility of the flash signature of the projectile 100 is further increased by directing signal powder 130 through the lateral sidewalls of the projectile 100. Because the signal powder 130 is directed through the sidewall of the projectile 100, as opposed to the rear, the flash signature generated by the flash producing material 142 remains unobstructed.

Figure 2:
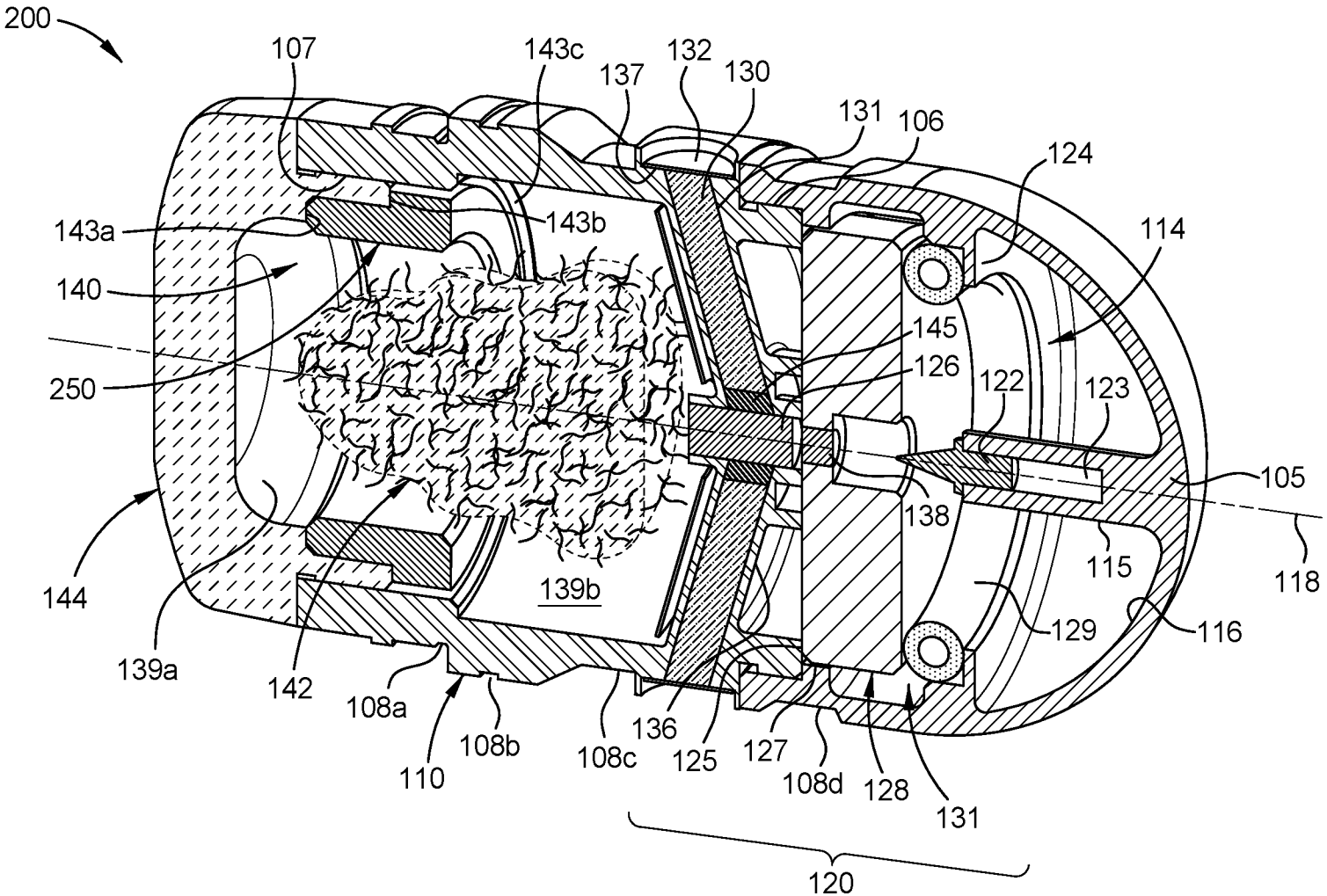
FIG. 2 is a cross sectional view of a projectile of a cartridge weighted with a ballast ring, according to one implementation.

FIG. 2 is a cross sectional view of a projectile 200 with a ballast ring 250, according to one implementation. The projectile 200 is similar to the projectile 100, but includes a ballast ring 250 is disposed within the cavity 140. The ballast ring 250 contacts the one or more shoulders 143*a*-143*c* of the rear flash chamber 140, and is maintained in position via an interference fit, and adhesive, a threaded connection, metallurgical bonding, or other retention alternative. The precise size, position, and weight of the ballast ring is selected in order to further facilitate proper weight balance and/or strength of the projectile 200. In some embodiments, the ballast ring 250 is formed of tungsten, tungsten-loaded plastic, lead, copper, or brass. However, other materials are also contemplated. It is contemplated that material selection may be based on the weight and/or density of the material, as well as compatibility with the flash producing material 142.

In the illustrated embodiment, the ballast ring 250 engages shoulders 143*a* and 143*b*. Engagement with the shoulders 143*a* and 143*b* prevents rearward shifting of the ballistic ring 250 upon firing of the projectile 200, enhancing ballistic accuracy of the projectile 200. It is contemplated, however, that the ballast ring 250 may be secured in other manners which prevent rearward shifting of the ballast ring 250, and thus, the ballast ring 250 may be located in other locations within the cavity 140.

Figure 3:
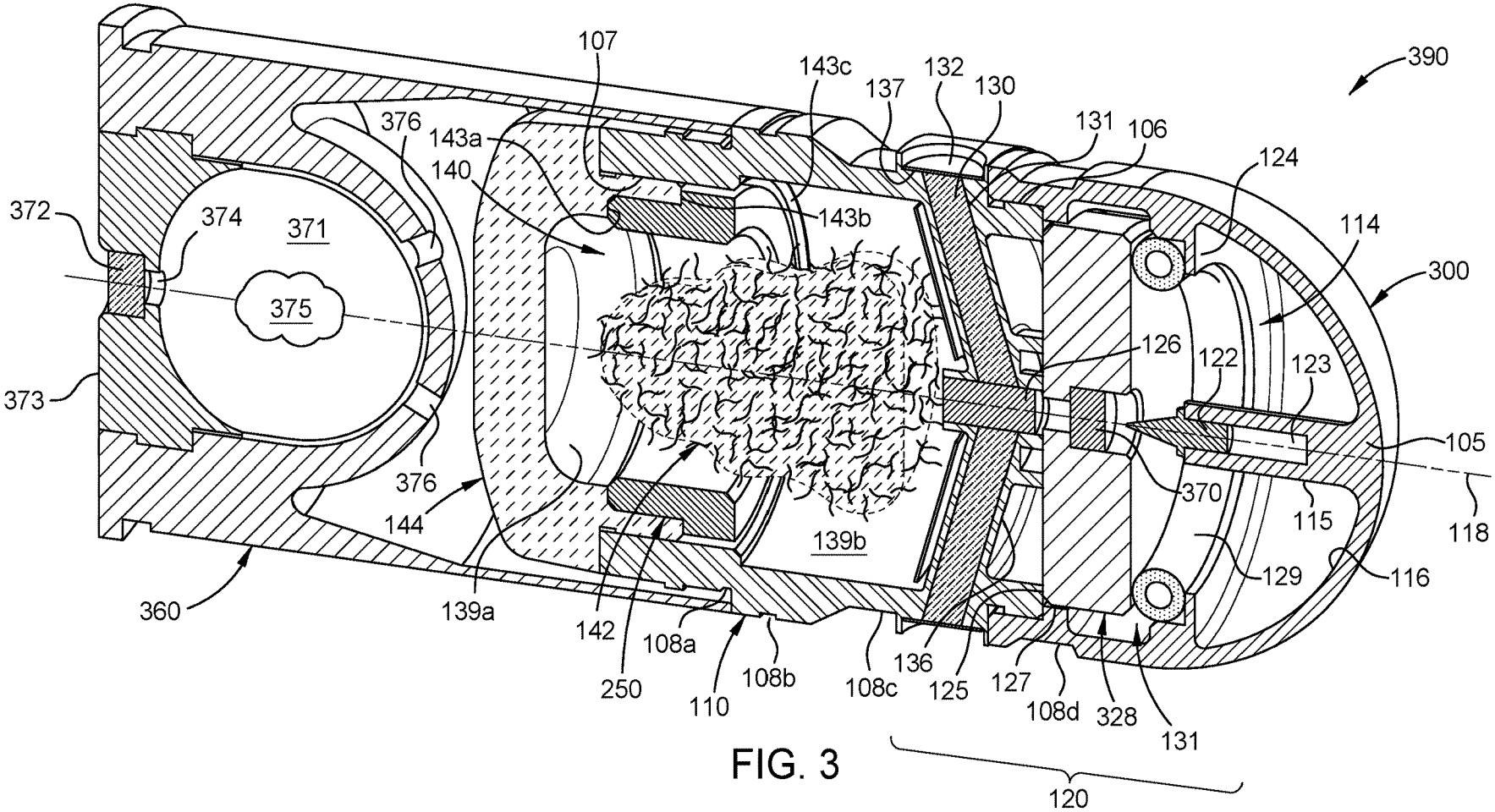
FIG. 3 is a cross sectional view of cartridge, according to one implementation.

FIG. 3 is a cross sectional view of a cartridge 390, which includes a projectile 300 mounted in a cartridge case 360, according to one implementation. While projectile 300 is illustrated, it is contemplated that the projectile 300 may be replaced by projectile 100 or projectile 200. The projectile 300 is similar to the projectile 200, however, the projectile 200 utilizes a detonator, such as a primer retainer 328 and primer 370, in place of the escapement 128. The primer retainer is a cylindrical disk, formed of, for example, a metal such as brass, or a polymer, and retains the primer centrally therein. The primer is positioned to engage the firing pin 122 and ignite the oxidizer/booster 126, upon forward movement of the primer retainer 328 at impact. While the projectile 300 is not shown with an optional piston 145, it is contemplated that an optional piston 145 may be included, as similarly shown in the projectile 200 of FIG. 2.

The cartridge case 360 is an aluminum, steel, brass, nickel, or nickel plated body which retains the projectile 300, as well as a propellant chamber 371 and a firing primer 372. The firing primer is retained in a retaining cup 373 at the rear of the cartridge case 360. The retaining cup 373 includes an opening 374 adjacent the firing primer 372 such that the firing primer 372 can ignite a propellant charge 375 located within the propellant chamber 371. The ignited propellant charge combusts upon ignition, forcing expanding gases through openings 376 (two are shown) to propel the projectile 300 from the cartridge case and down the barrel of a firearm.

Figure 4:
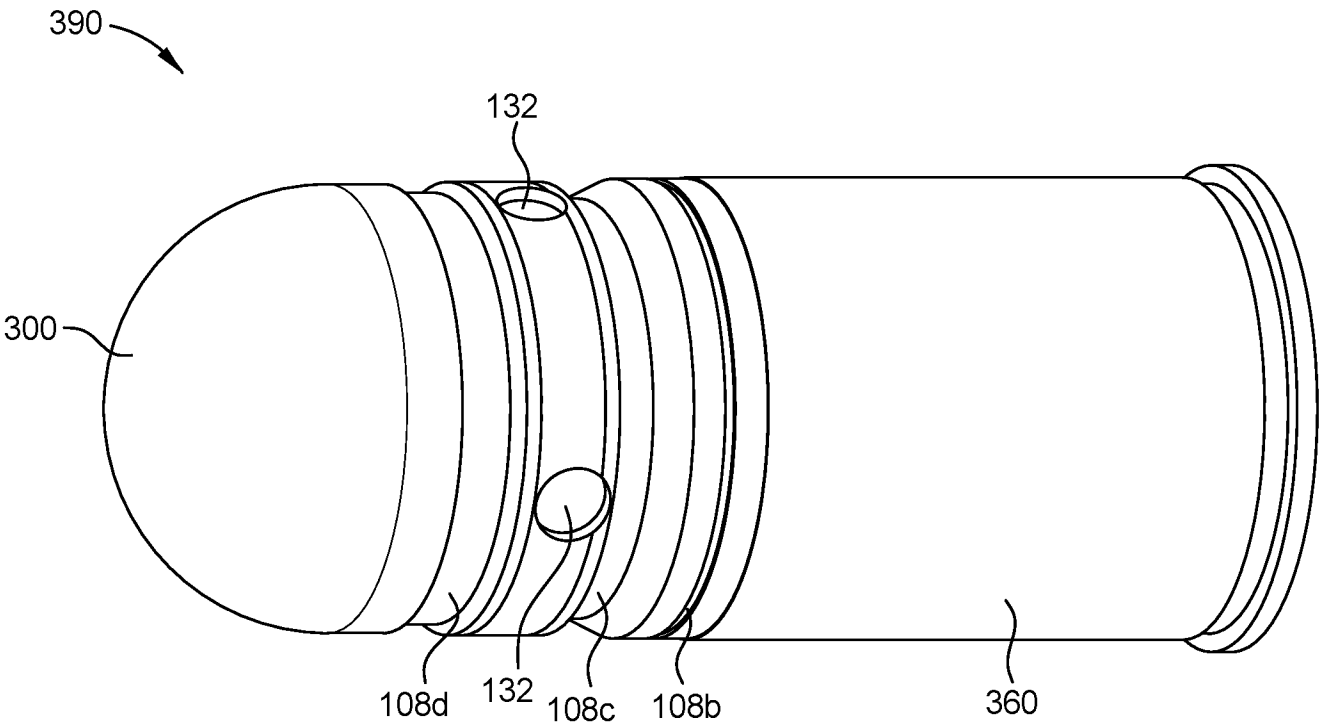
FIG. 4 is a perspective view of a cartridge, according to certain embodiments.

FIG. 4 is a perspective view of the cartridge 390 of FIG. 3, according to certain embodiments. A plurality of ringed grooves 108*b*, 108*c*, 108*d*, as well as a plurality of environmental seals 132, are visible in the perspective view. The cartridge 390 is designed to look and perform like a standard ammunition round. For example, the cartridge 390 may look and perform similar to a M430A1 cartridge. However, it is contemplated that the cartridge 390 may also be used in 40 mm, 57 mm, and other caliber configurations, as well as in other projectiles or munitions.

Benefits of the present disclosure include providing a projectile that emits flash, thermal, and smoke signals upon impact for training or tactical purposes. These signals allow training to be conducted at all times of day, with multiple signals utilized in order to allow the point of impact to be identified. The rear flash produces a visible signal even when the front of the projectile is buried in its target. The rear flash is equipped to be a rapid flash signal, rather than a lingering one, to simulate the flash of a standard grenade. The smoke signal is emitted from the sides of the projectile body in order to mitigate obstruction of the rear flash signal. Additionally, one or both of the smoke and flash signals produce a thermal signal. The combination of these signals permit better detection upon impact. Moreover, aspects disclosed herein are safe, reliable, and easy to manufacture.

Other benefits include the addition of features which are designed to prevent fires, early detonation, and hazardous duds. Some of the safety features include flash wool technology which creates a flash contained within the rear flash chamber. Additional safety features include utilizing the ignition charge to engage the signal powder and produce the smoke signal, as opposed to gas pressure from ignition as seen in previous projectile designs.

While the foregoing is directed to embodiments of the present disclosure, other and further embodiments of the disclosure may be devised without departing from the basic scope thereof, and the scope thereof is determined by the claims that follow.

What is claimed is:

1. A projectile comprising:
a projectile body;
an ogive coupled to the projectile body;
a boat tail having a degree of transparency coupled to the projectile body and defining a cavity within the boat tail and the projectile body;
a flash producing material disposed within the cavity, wherein the flash producing material is configured to create a light signal visible through the boat tail;
an oxidizer disposed in the cavity;
a plurality of powder channels exiting a sidewall of the projectile body, wherein the plurality of powder channels house a signal powder;
a detonator operable to ignite the oxidizer; and
a firing pin operable to ignite the detonator.

2. The projectile of claim 1, wherein the boat tail comprises a polycarbonate, acrylic, or other polymer or glass based material.

3. The projectile of claim 1, further comprising:
a biasing member; and
an escapement in contact with the biasing member adjacent the firing pin,
wherein the firing pin is disposed in the ogive.

4. The projectile of claim 1, wherein a piston operatively coupled to the signal powder is configured to expel the signal powder from the powder channels.

5. The projectile of claim 1, wherein the cavity comprises a reflective surface for focusing the light signal.

6. A projectile for a cartridge, comprising:
a projectile body;
an ogive coupled to the projectile body;
a boat tail having a degree of transparency coupled to the projectile body;
a flash producing material adjacent the boat tail;
an oxidizer;
a plurality of powder channels disposed between the oxidizer and an external sidewall of the projectile body;
a signal powder is disposed within the plurality of powder channels;
a detonator operable to ignite the oxidizer; and
a firing pin operable to ignite the detonator.

7. The projectile of claim 6, wherein each powder channel of the plurality of powder channels further comprises an environmental seal disposed at a distal end of each powder channel.

8. The projectile of claim 6, wherein the signal powder is operably coupled to the oxidizer.

9. The projectile of claim 8, further comprising a piston operably coupled to the signal powder.

10. The projectile of claim 6, wherein the powder channels are disposed at an angle between about 65 degrees to about 90 degrees relative to a longitudinal axis of the projectile.

11. A projectile for a cartridge, comprising:
a projectile body;

an ogive coupled to the projectile body;

a boat tail having a degree of transparency coupled to the projectile body;

a first cavity defined by the projectile body and the ogive, the first cavity comprising:

a support post disposed within the first cavity;

a firing pin disposed within a pocket of the support post;

a second cavity defined by the boat tail having a degree of transparency and the projectile body, the second cavity comprising:

a flash producing material disposed in the second cavity;

a detonator disposed between the first cavity and the second cavity;

an oxidizer disposed between the firing pin and detonator;

a plurality of powder channels extending between the oxidizer and an external surface of the projectile body; and a signal powder housed in the plurality of powder channels.

12. The projectile of claim 11, further comprising:

a piston operably coupled to the signal powder.

13. The projectile of claim 12, wherein the projectile is operable to emit one or more smoke signals.

14. The projectile of claim 13, wherein the one or more smoke signals is created by an expulsion of the signal powder through the plurality of powder channels.

15. The projectile of claim 11, wherein the projectile is configured to emit one or more light signals.

16. The projectile of claim 15, wherein the one or more light signals comprise a wavelength in a visible spectrum or an infrared spectrum.

17. The projectile of claim 15, wherein the one or more light signals ceases to emit light within three seconds.

18. The projectile of claim 11, wherein the projectile is operable to eject light-reflecting powder from the plurality of powder channels to increase a light signature generated by the flash producing material.

* * * * *